US006032602A

United States Patent [19]

Ehluss et al.

[11] Patent Number: 6,032,602

[45] Date of Patent: Mar. 7, 2000

[54] STABILIZER FOR OCEAN GOING VESSELS AND A STABILIZER FOR OTHER OCEAN GOING BODIES, SUCH AS SHIPS

[75] Inventors: Heinz-Günter Ehluss, Tornesch; Dirk Jürgens, Hamburg; Christian Thieme, Beunstorf, all of Germany

[73] Assignee: Blohm & Voss AG, Hamburg, Germany

[21] Appl. No.: 08/818,673

[22] Filed: Mar. 14, 1997

[30] Foreign Application Priority Data

Mar. 15, 1996 [DE] Germany ..... 196 10 870

[51] Int. Cl.[7] ..... B63B 39/06

[52] U.S. Cl. ..... 114/126; 114/163

[58] Field of Search ..... 114/126, 162, 114/163, 164, 167, 272, 278

[56] References Cited

U.S. PATENT DOCUMENTS 3,643,617 2/1972 Holden ..... 114/126

4,510,880 4/1985 Kuribayashi ..... 114/162

4,535,714 8/1985 Petersen ..... 114/162

*Primary Examiner*—Jesus D. Sotelo

*Attorney, Agent, or Firm*—Nils H. Ljungman & Associates

[57] ABSTRACT

A device for guiding the flow of floating objects. The device is connected to a hull of the floating object and, depending on the flow, feeds hydrodynamic forces into the hull. The device shows a main flow body which is designed in a more flat-topped manner in the area of a leading head than in the area of a trailing end. In the flow direction, a secondary body is placed behind the trailing end, which secondary body shows a rounded cross-sectional contour. The secondary body is equipped with a flow-through recess. Furthermore, the secondary body is, regarding an axis of revolution that runs at an angle to the flow direction, guided in an adjustable manner.

20 Claims, 7 Drawing Sheets

STABILIZER FOR OCEAN GOING VESSELS AND A STABILIZER FOR OTHER OCEAN GOING BODIES, SUCH AS SHIPS

BACKGROUND OF THE INVENTION

1. Field of the Invention

The present invention relates to a device for guiding the flow of floating objects, which device is connected to a hull of the floating object and, depending on the flow, feeds hydrodynamic forces into the hull. The device shows a main flow body which is designed in a more flat-topped manner in the area of a leading head than in the area of a trailing end.

2. Background Information

Such devices for guiding the flow are, for example, designed as fins on fin stabilizers or blades on ships' rudders on vessels. These devices are known in various embodiments and they have proven to be a success for many, many years. However, it is not yet possible to meet all of the requirements which are set concerning the feeding of high hydrodynamic flow forces into a floating object.

OBJECT OF THE INVENTION

Therefore, it is the objective of the present invention to design and construct a device of the kind mentioned in the introduction so that a further improvement in the hydrodynamic properties is achieved.

SUMMARY OF THE INVENTION

According to the invention, this problem is solved in that in the flow direction, a secondary body is placed behind the trailing end, which secondary body is equipped with a flow-through recess and which secondary body is, regarding an axis of revolution that runs at an angle to the flow direction, guided in an adjustable manner.

Such a secondary body can be placed in the area of adjustable main flow bodies as well as in the area of fixed main flow bodies which provide a flow profile. Combining the main flow body with the secondary body provides for a device that is extremely effective in a hydrodynamic sense, and which device has a simple constructional design. In particular, the secondary body can easily be positioned against the main flow body so that a compact embodiment is provided for. Through a corresponding relative arrangement of the components to one another, a high buoyancy effect can be achieved.

A symmetrical generation of force, relative to the axis of revolution, can be supported in that a cross-sectional contour of the secondary body is demarcated essentially in a circular manner. In principle, commonly rounded cross-sectional contours or cross-sectional contours that are stretched out by two flow flaps can also be used.

An economical production is supported in that the flow-through recess can be placed as a longitudinal slot inside the secondary body.

An increased rigidity can be provided in that the longitudinal slot can be divided into slot segments.

To provide defined and reproducible flow ratios, it is suggested that the positioning of the secondary body is coupled with the positioning of the main flow body.

A preferred construction of the coupling is established in that the coupling of the secondary body with the main flow body can be designed in such a way that with swivelling of the main flow body around a main axis of revolution, swivelling of the secondary body around the axis of revolution is realized in a ratio of 1:1.5. Generally, even higher transmission ratios are realizable.

A more even feeding of forces can take place in that the flow-through recess is placed essentially in the center of the secondary flow body within the cross-sectional contour.

To adapt to typical hydrodynamic demands, it is suggested that the main flow body and the secondary body show a sense of rotation essentially in the same direction.

A low-cost embodiment with high stability is provided in that the secondary body can be designed as a slotted steel tube.

A robust realization of the coupling can be established in that the coupling of the main flow body with the secondary body can be realized over at least one gear. For example, a shear crank gear can be used.

A typical application exists in that a linear coupling of the angles of rotation of the secondary body and the main flow body is provided.

In the case of special applications, it is also possible that a non-linear coupling of the angles of rotation of the secondary body and the main flow body can be provided.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

In the drawings, embodiments of the invention are illustrated in diagram form, in which.

DESCRIPTION OF THE PREFERRED EMBODIMENT

Figure 1:
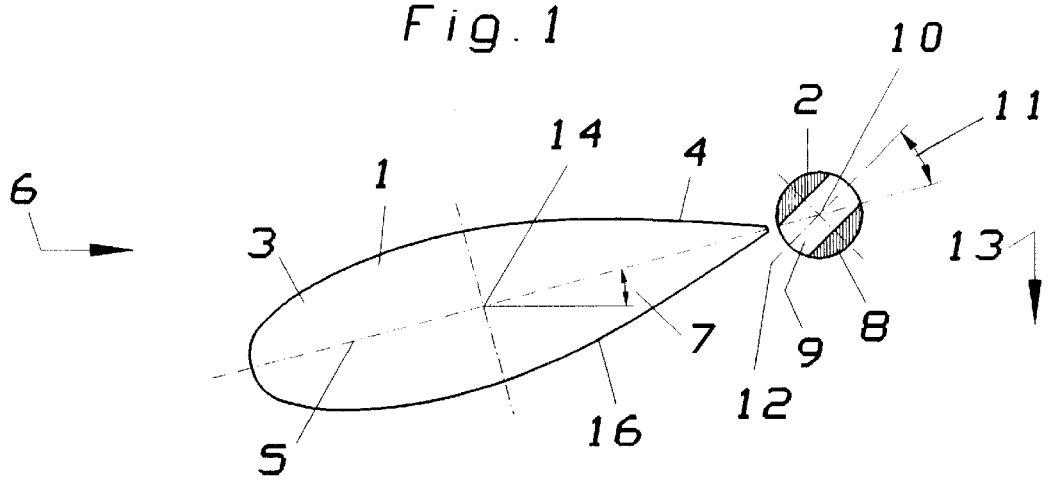
FIG. 1 shows a model illustration of the arrangement of a secondary body placed in the area of the main flow body and twisted relative to the flow direction.

In FIG. 1, a secondary body 2 is placed in the area of a main flow body 1. The main flow body 1 shows an upstream or leading head or end 3 which can be designed in a more flat-topped manner than the trailing or downstream end 4. From the leading head 3 in the direction of the trailing end 4, a flow direction 5 extends which reflects the orientation of a main flow in the area of the main flow body 1. An on-flow 6 or approaching flow acts upon the main flow body 1, relative to which on-flow 6 the main flow body 1 shows a setting angle 7 in the embodiment of FIG. 1. Because of the setting angle 7, the on-flow 6 is, in the area of the main flow body 1, deflected in the flow direction 5.

The secondary body 2 has, in the embodiment pursuant to FIG. 1, a rounded cross-sectional contour 8, and the secondary body 2 is equipped with a flow-through recess 9. The secondary body 2 can be swivelable around an axis of revolution 10 and can have, relative to the flow direction 5, an adjustable angle 11. In particular, it was considered to couple the secondary body 2 with the main flow body 1 over a gear in such a way that a certain setting angle 7 would automatically lead to a pre-determined adjustable angle 11.

In the embodiment of FIG. 1, the flow-through recess 9 can be placed symmetrically in the secondary body 2. As a result of this, a favorable feeding of forces is made possible in the area of the position of the secondary body 2.

In the embodiment depicted in FIG. 1, the flow through recess or channel 9 through the secondary body 2 can be essentially in the form of a straight channel. In accordance with one embodiment, where the channel 9 is a straight channel, the ratio of the width of the channel to the length of the channel can be, for example, approximately 0.625:1. Alternatively, the channel also could, for example, have a diameter to length ratio of 0.4:1; 0.425:1; 0.45:1; 0.475:1; 0.5:1; 0.525:1; 0.55:1; 0.575:1; 0.6:1; 0.65:1; 0.675:1; 0.7:1; 0.725:1; 0.75:1; 0.775:1; 0.8:1; 0.825:1; 0.85:1; 0.875:1 or 0.9:1. In some alternative embodiments, the ratio of the width to the length could also be less than 0.4:1 or greater than 0.9:1.

Figure 2:
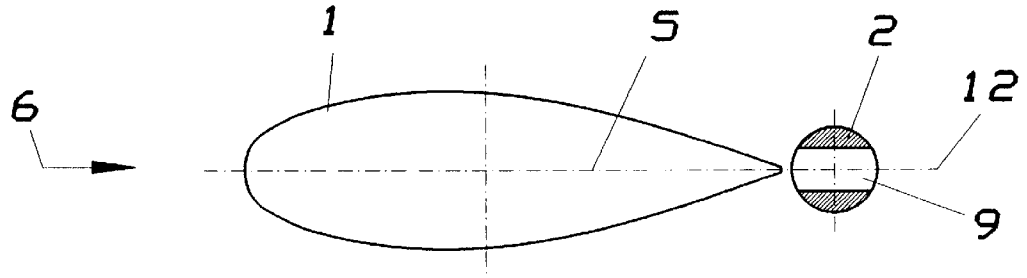
FIG. 2 shows an illustration of the device, pursuant to FIG. 1, in an initial state.

FIG. 2 shows a layout of the device pursuant to FIG. 1 where the flow direction 5 extends in the direction of the on-flow 6. Also, the flow-through recess 9 can be aligned with a flow-through axle 12 in the flow direction 5.

Figure 3:
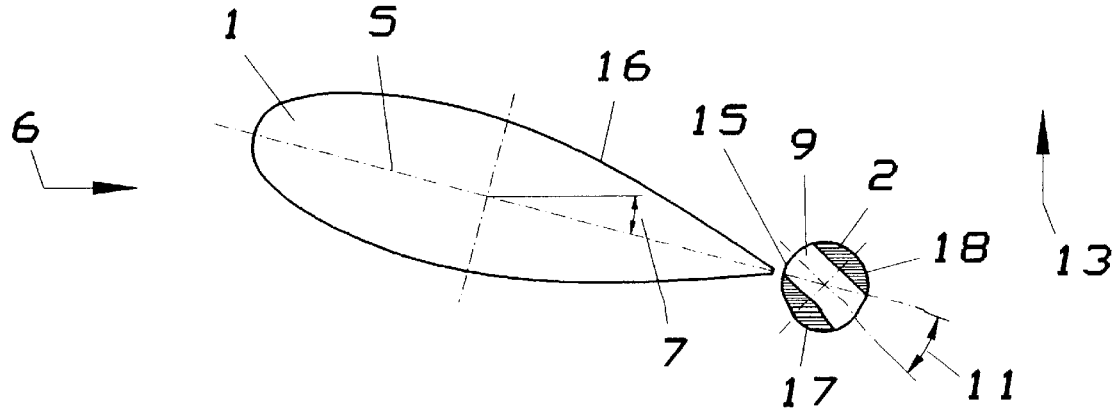
FIG. 3 shows the device illustrated pursuant to FIG. 1 with an opposite angle of swivelling.

FIG. 3 shows the layout of the device pursuant to FIG. 1 with an opposite setting angle 7 as well as with a corresponding orientation of the secondary body 2. In FIG. 1 as well as in FIG. 3, the resulting hydrodynamic direction of force 13 is drawn in and is represented by an arrow.

By combining the main flow body 1 and the secondary body 2, for example, a stabilizing fin or a roller insulation fin for sea vessels can be provided. The secondary body 2 can be made of a steel tube, for example, which can be equipped with a longitudinal slot. The longitudinal slot can be placed symmetrically so that a demarcation by two symmetrically designed circular segments takes place. To couple the secondary body 2 with the main flow body 1, a shear crank gear can be used, for example.

The motion ratio for the coupling of the main flow body 1 and the secondary body 2 can be assigned by the gear. The rate 1.5 as the adjustable ratio for the quotient from the setting angle 7 and the adjustable angle 11 has been proven advantageous. For practical reasons, the rate should be chosen in an interval of about 1.2 through about 1.8.

With a rotation of the main flow body 1 around its main axis of revolution 14 and the secondary body 2 around the axis of revolution 10, a rotation in the same direction emerges so that an inflow opening 15 of the secondary body 2 always points to the area of that surface 16 of the main flow body 1 which is oriented, due to the twist of the main flow body 1, turned away from the on-flow 6. In the example illustrated, the setting angle 7 runs at approximately 20° and the adjustable angle 11 runs at approximately 30°.

The operation of the device results essentially from the following: with the adjustment of the main flow body 1, a segment 17 of the secondary body 2 (see FIG. 3) shows, with a growing adjustable angle 11, the effect of a flap that increasingly adjusts to the flow. From this results an increase in buoyancy through the action of the flaps. With a growing adjustable angle 11, the flow-through recess 9 is also, in the buoyancy direction, increasingly turned toward the surface 16 of the main flow body 1. As a result of this, water is carried off from the eddy zone in the area of the trailing end 4, and the negative pressure area is extended on the surface 16, acting here as the profile's upper surface. A segment 18 of the secondary body 2, placed correspondingly to the segment 17, exercises, with a growing adjustable angle 11, the function of a diminishing tail profile with an additional buoyancy portion.

The symmetrical arrangement of the segments 17, 18, relative to the flow-through recess 9, has the further advantage that while twisting during the adjustable movement, only a small rotational moment must be expended since no flow forces, acting outside the axis of revolution 10, become active.

Figure 4:
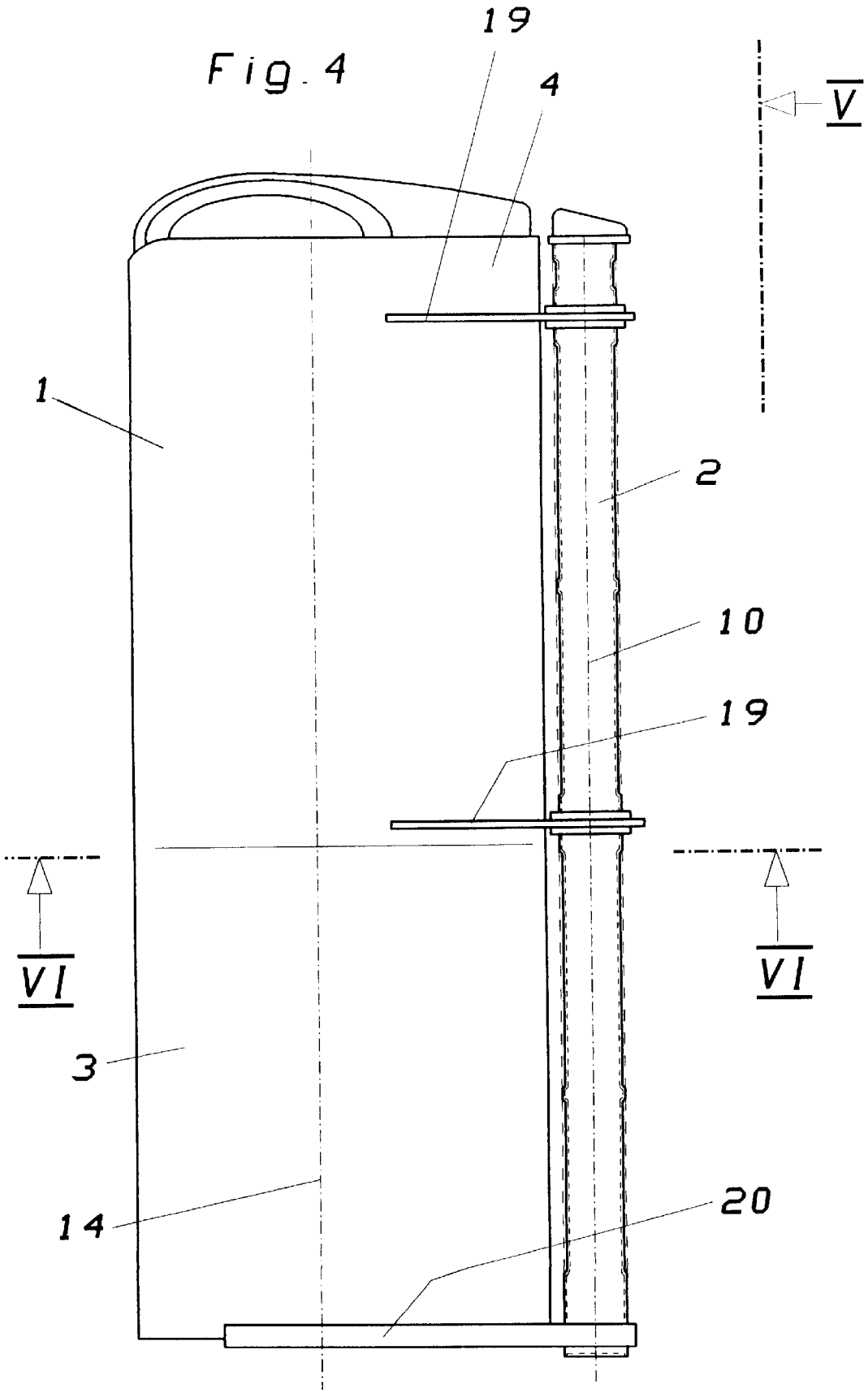
FIG. 4 shows a top view of the device.

FIG. 4 shows in a top view a possibility as to the position of the secondary body 2 in the area of the main body 1. Two supporting bridges 19 and a carrying arm 20 are provided for, and in this area the gear coupling also takes place.

Figure 4A:
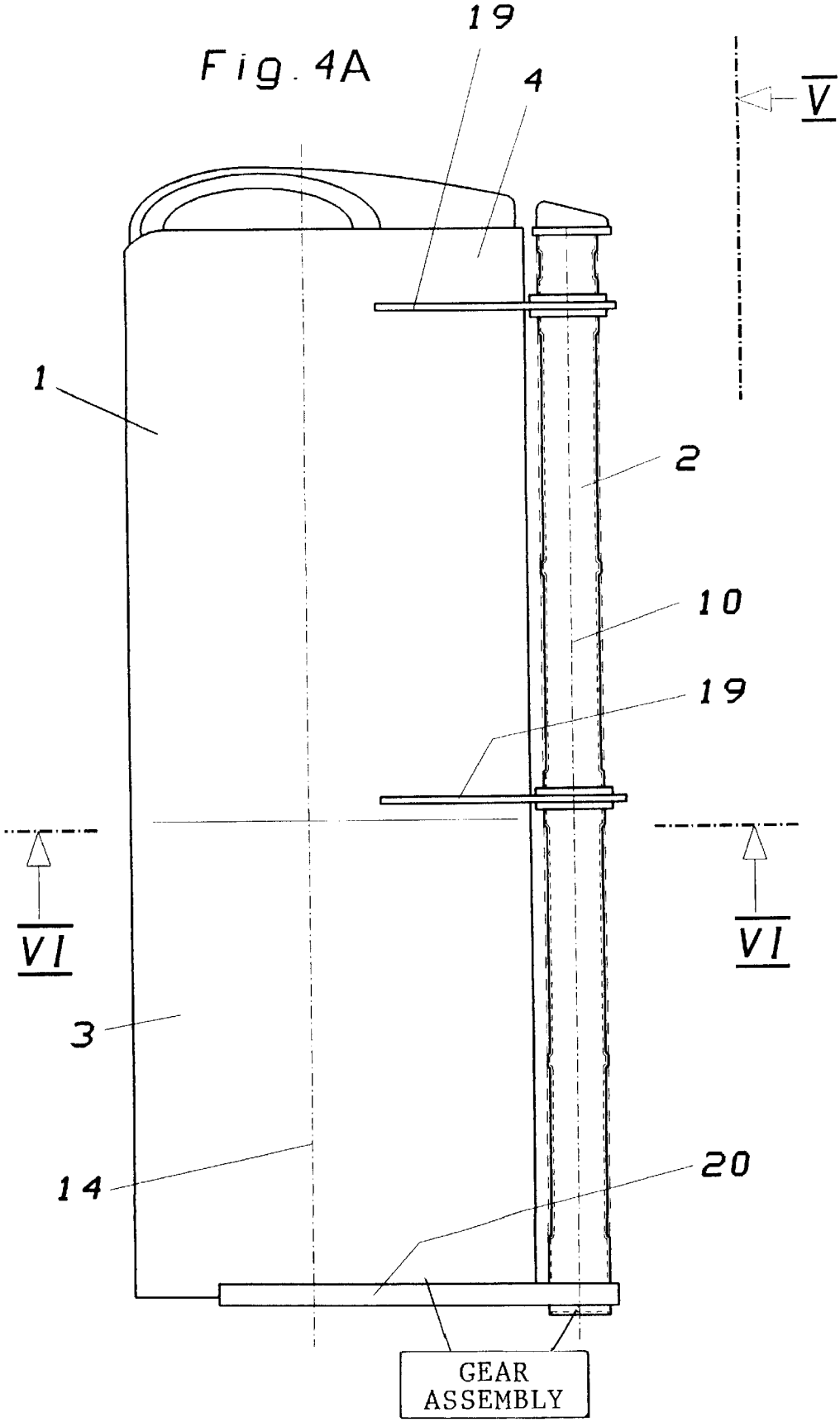
FIG. 4A shows additional detail of the view in FIG. 4.

FIG. 4A shows an embodiment containing a gear system (shown schematically) that can be used to rotate the secondary body 2 upon rotation of the main body 1.

Figure 5:
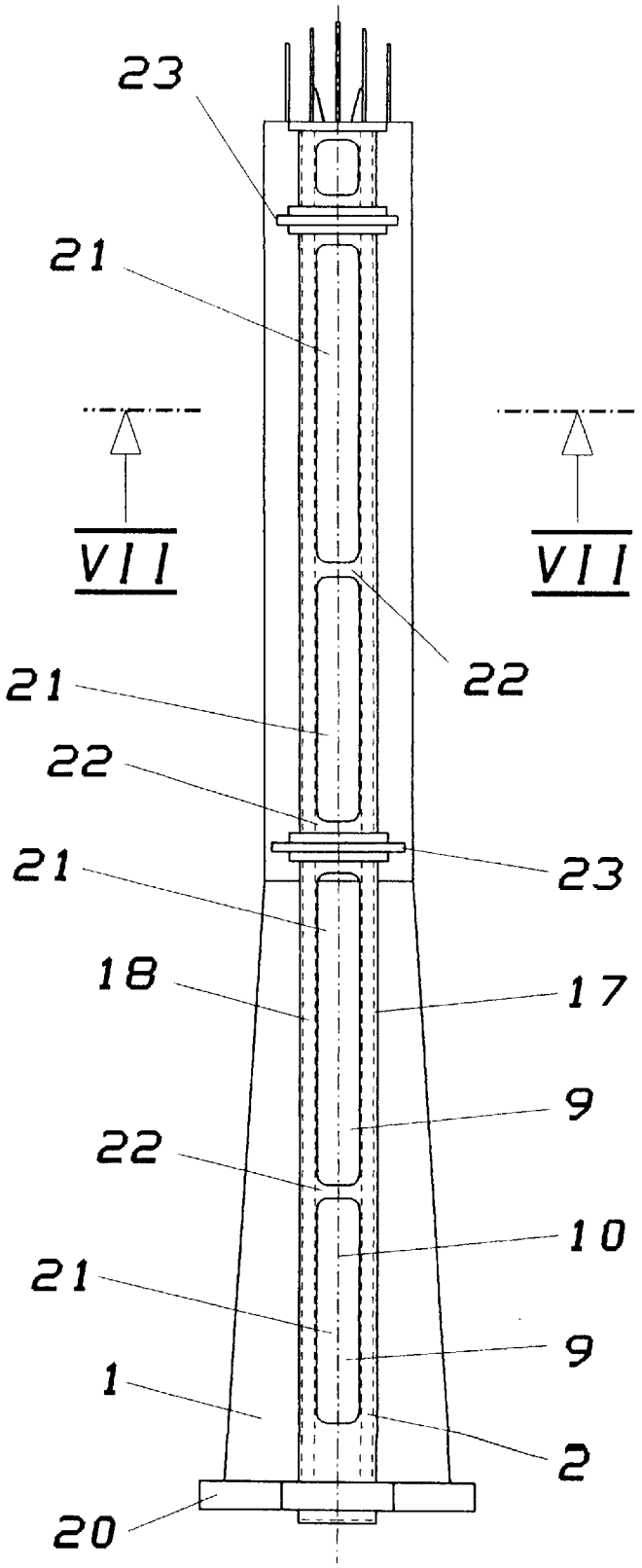
FIG. 5 shows a view of the device in FIG. 4 pursuant to the line of sight V.

FIG. 5 shows an embodiment where the flow-through recess 9 is designed from slot segments 21. Between the slot segments 21, in each case a supporting bridge 22 is provided which connects the segments 17, 18 with one another for reinforcement purposes. From FIG. 5 it can also be gathered that the supporting bridges 19, in the area of holding rings 23, are connected to the secondary body 2. To aid a low flow resistance, the supporting bridges 22 are lead into the flanks of the segments 17, 18 in a rounded manner.

Figure 6:
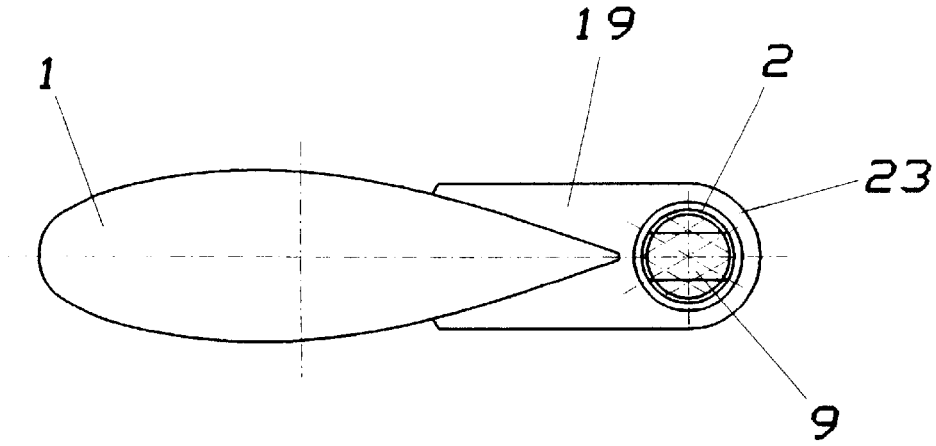
FIG. 6 shows a cross section pursuant to the cutting line VI—VI in FIG. 4.
Figure 7:
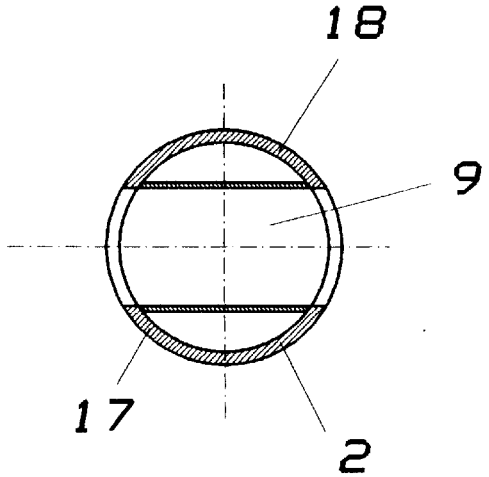
FIG. 7 shows a cross section of the secondary body, pursuant to the cutting line VII—VII in FIG. 5.
Figure 8:
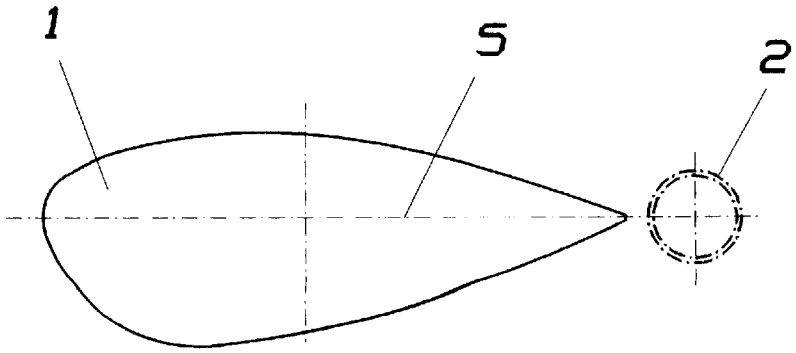
FIG. 8 shows a cross section of a device which is equipped, relative to the flow direction, with an asymmetrical main flow body.

For further illustration, cross sections are presented in FIG. 6 and FIG. 7. From FIG. 8 it can be gathered that it is possible to use, relative to the flow direction 5, asymmetrically designed main flow bodies 1.

Figure 9:
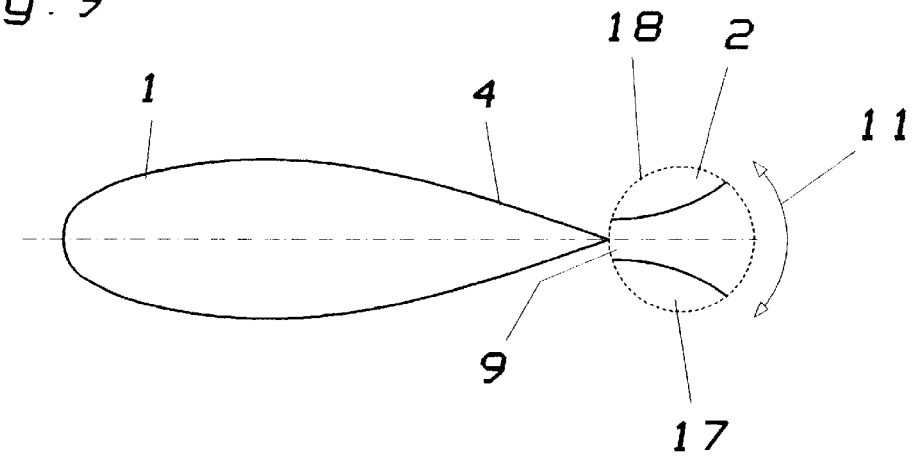
FIG. 9 shows an embodiment where the secondary body shows a widening flow-through recess in the flow direction.

Pursuant to the embodiment in FIG. 9, the flow-through recess 9 shows a design that widens leading off from the trailing end 4 of the main flow body 1. In particular, it was considered not to provide for a continuous cross-sectional expansion but rather to realize, with growing distance from the trailing end 4, a progressive cross-sectional increase. Leading off from the trailing end 4, curved demarcation areas of the segments 17,18 emerge from this in the area of their demarcations that are turned to the flow-through recess 9.

Figure 9A:
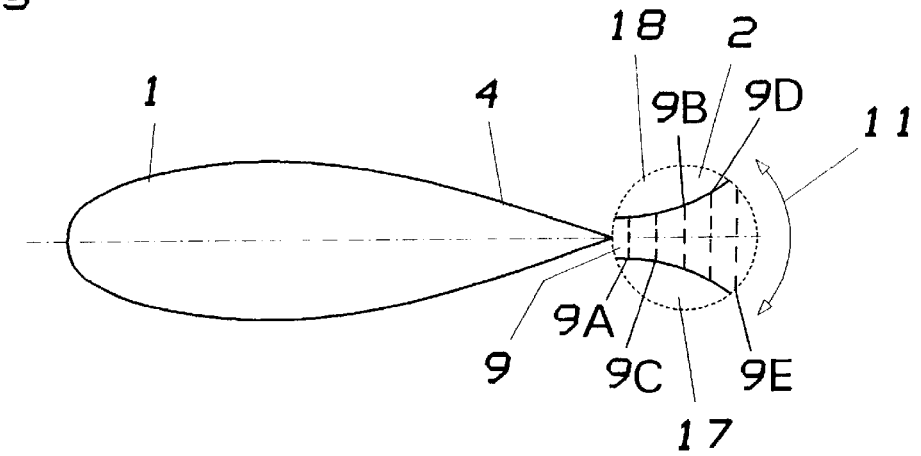
FIG. 9A shows the embodiment depicted in FIG. 9 including additional detail.

In the embodiment depicted in FIGS. 9 and 9A, the flow through recess or channel 9 through the secondary body 2 can be, as described above, essentially in the form of a channel which increases in width as the distance from the trailing end 4 increases. The increase in width can be a linear increase, with the width increasing directly in proportion to the distance from the trailing end 4, or, as depicted in FIG. 9, the width can increase non-proportionally, for example exponentially or logarithmically.

Preferably, in accordance with one embodiment, the width to length ratio of the channel can be approximately 0.5:1 at the end 9A of the flow-through recess 9 nearest the trailing end 4, where the width is the distance across the flow-through recess at any given point and the length is the distance between ends 9A and 9E. At the end 9E furthest from the trailing end 4, the ratio of the width of the channel to the length can be approximately 0.9:1. The ratio of the width to the length at point 9B, which point 9B is approximately ¼ of the distance between from end 9A to end 9E, can be about 0.525:1. In this embodiment, the ratio of the width to the length of flow-through recess 9, at the midpoint 9C between ends 9A and 9E, can be about 0.6:1. Point 9D, which point 9D is about ¾ of the distance from end 9A to end 9E, can have a width to length ratio of about 0.7:1. Further, the ratio of the width at end 9E to the width at end 9A can be about 1.8:1.

In other embodiments, the ratio of the width to the length at end 9A can be about: 0.3:1; 0.325:1; 0.350:1; 0.375:1; 0.4:1; 0.425:1; 0.45:1; 0.475:1; 0.525:1; 0.55:1; 0.575:1; 0.6:1; 0.625:1; 0.650:1; 0.675:1 or 0.7:1. The width to length ratio at end 9E can be about: 0.6:1; 0.625:1; 0.65:1; 0.675:1; 0.7:1; 0.725:1; 0.75:1; 0.7775:1; 0.8:1; 0.825:1; 0.85:1; 0.875:1; 0.925:1; 0.95:1; 0.975:1; 1:1; 1.1.025:1; 1.05:1; 1.075:1; 1.1:1; 1.125:1; 1.15:1; 1.175:1; and 1.2:1. The width of points 9B, 9C and 9D, will preferably be greater than the width at end 9A and less than the width at end 9E.

In other embodiments, the ratio of the width at end 9C to the width at end 9A can be about: 1.6:1; 1.625:1; 1.65:1; 1.675:1; 1.7:1; 1.725:1; 1.75:1; 1.775:1; 1.825:1; 1.85:1; 1.875:1; 1.9:1; 1.925:1; 1.95:1; 1.975:1 or 2:1.

Figure 10:
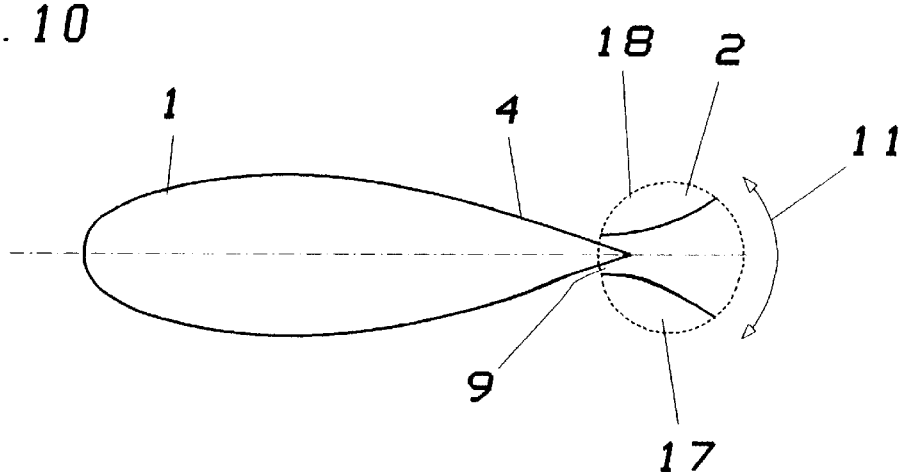
FIG. 10 shows an embodiment where some areas of the main flow body and the secondary body overlap.

FIG. 10 shows another variation where the trailing end 4 of the main flow body 1 projects into the flow-through recess 9 of the secondary body 2. Subject to the dimensioning of the mutual overlapping, a reduction in the realizable adjustable angle 11 could result from this, however, a further improvement in the guiding of the flow is achieved.

Figure 11:
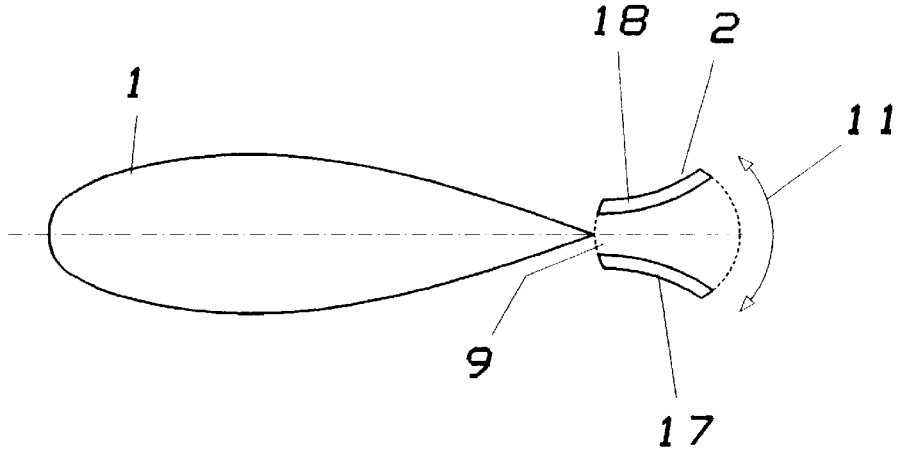
FIG. 11 shows an embodiment where the secondary body is equipped with two flat flow flaps.

In the case of the embodiment pursuant to FIG. 11, the segments 17, 18 of the secondary body 2 are designed in a flap-like manner. As a result of this, a double flap is provided which leads, with a corresponding separate rotational position, to a decrease in the arising moments. In particular, it is also possible to camber the segments 17, 18 and to shape the area of their ends to a point to realize a further improvement in the guiding of the flow. The flap-like design of the segments 17, 18, as illustrated in FIG. 11, leads to the following: Through the segment 17, marked as the lower flap, a flow deflection with smooth trailing emerges. As a result of this, an increase in the circulation and an extension of the induced setting angle on the segment 17 is generated. Through segment 18, designed as the upper flap in FIG. 11, the suction side flow on the main flow body 1 is accelerated and, as a result of this, the danger of detachment is reduced. This facilitates the distribution of negative pressure. This generates, all in all, an improvement in the circulation and a decrease in the eddy or in the dead areas in the surroundings of the main flow body 1. As a result of this, vibrational excitations can be avoided or at least reduced.

Figure 12:
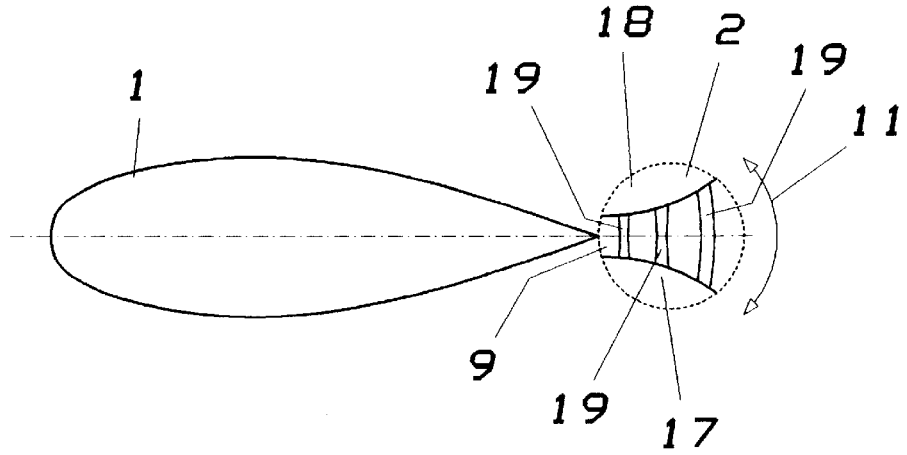
FIG. 12 shows an embodiment with a widening flow-through recess of the secondary body where supporting bridges are placed inside the flow-through recess for reinforcement purposes.

In FIG. 12, supporting bridges 19 are placed, relative to each other, in the area of the flow-through recess 9 to stabilize the segments 17, 18. In the cross direction, the supporting bridges 19 show, as in the embodiment of FIG. 5, sufficient distance so that flow-through is not impeded.

Figure 13:
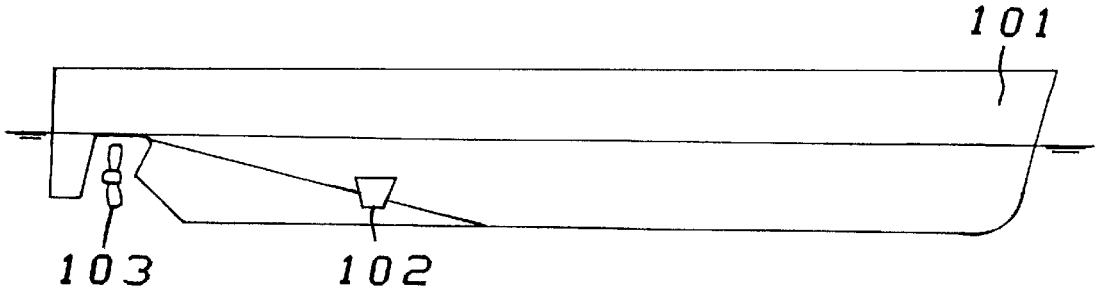
FIG. 13 shows a side view of a hull of a ship.

FIG. 13 shows a side view of a hull 101 of a ship in which the present invention can be incorporated. The hull 101 has a stabilizer fin 102 and a rudder 103.

One feature of the invention resides broadly in the device for guiding the flow of floating objects, which device is connected to a hull of the floating object; and, depending on the flow, feeds hydrodynamic forces into the hull; and shows a main flow body which is designed in a more flat-topped manner in the area of a leading head than in the area of a trailing end, distinguished in that in the flow direction 5 a secondary body 2 is placed behind the trailing end 4 which secondary body is equipped with a flow-through recess 9 and which secondary body is, regarding an axis of revolution 10 that runs at an angle to the flow direction 5, guided in an adjustable manner.

Another feature of the invention resides broadly in the device distinguished in that the cross-sectional contour 8 is demarcated essentially in a circular manner.

Yet another feature of the invention resides broadly in the device distinguished in that the flow-through recess 9 is placed as a longitudinal slot inside the secondary body 2.

Still another feature of the invention resides broadly in the device distinguished in that the longitudinal slot is divided into slot segments 21.

A further feature of the invention resides broadly in the device distinguished in that the positioning of the secondary body 2 is coupled with the positioning of the main flow body 1.

Another feature of the invention resides broadly in the device distinguished in that the coupling of the secondary body 2 with the main flow body 1 is designed in such a way that with swivelling of the main flow body 1 around a main axis of revolution 14, swivelling of the secondary body 2 around the axis of revolution 10 is realized in a ratio of 1:1.5.

Yet another feature of the invention resides broadly in the device distinguished in that the flow-through recess 9 is placed essentially in the center within the cross-sectional contour 8.

Still another feature of the invention resides broadly in the device distinguished in that the main flow body 1 and the secondary body 2 show a sense of rotation essentially in the same direction.

A further feature of the invention resides broadly in the device distinguished in that the secondary body 2 is designed as a slotted steel tube.

Another feature of the invention resides broadly in the device distinguished in that the coupling of the main flow body 1 with the secondary body 2 is realized over at least one gear.

Yet another feature of the invention resides broadly in the device distinguished in that a linear coupling of the angles of rotation of the secondary body 2 and the main flow body 1 is provided.

Still another feature of the invention resides broadly in the device distinguished in that a non-linear coupling of the angles of rotation of the secondary body 2 and the main flow body 1 is provided.

A further feature of the invention resides broadly in the device distinguished in that the flow-through recess 9 of the secondary body 2 widens in the direction turned away from the main flow body 1.

Another feature of the invention resides broadly in the device distinguished in that the segments 17,18, which demarcate the flow-through recess 9, are designed in a flap-like manner.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, are hereby incorporated by reference as if set forth in their entirety herein.

The corresponding foreign patent publication applications, namely, Federal Republic of Germany Patent Application No. 196 10 870.5, filed on Mar. 15, 1996, having inventors Heinz-Günter Ehluss, Dr. Dirk Jürgens, and Christian Thieme, and DE-OS 196 10 870.5 and DE-PS 196 10 870.5, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A device for guiding the flow of liquid across a stabilizing body for stabilizing a floating object, the floating object having a hull, said device comprising:

a first flow body;

said first flow body comprising an arrangement to connect said first flow body to a floating object;

said first flow body having an upstream edge and a downstream edge;

a second flow body;

said second flow body being disposed downstream of said downstream edge of said first flow body;

said second flow body comprises a flow channel; and said flow channel being disposed to allow water passing across said first flow body to flow through said flow channel of said second flow body.

2. The device according to claim 1 wherein:

said first flow body has a longitudinal axis extending from said upstream edge to said downstream edge;

said second flow body has an axis of rotation;

said axis of rotation of said second flow body is substantially transverse to said longitudinal axis of said first flow body; and said second flow body is rotatable about said axis of rotation to adjust a flow path of water passing said first flow body.

3. The device according to claim 2 wherein:

said first flow body has a first thickness defined substantially adjacent said upstream edge;

said first flow body has a second thickness defined substantially adjacent said downstream edge;

said first and second thicknesses are defined substantially transverse to said longitudinal axis; and said first thickness is substantially greater than said second thickness.

4. The device according to claim 3 wherein said flow channel comprises a recess disposed within said second flow body.

5. The device according to claim 4 wherein:

said first flow body has an axis of rotation; and said first flow body comprises means for rotating said second flow body about said axis of rotation of said second flow body upon rotation of said first flow body about said axis of rotation of said first flow body.

6. The device according to claim 5, wherein:

said rotating means comprises means for rotating said second flow body in the same direction of rotation as said first flow body; and said means for rotating said second flow body in the same direction of rotation as said first flow body comprises at least one gear.

7. The device according to claim 6 wherein:

said second flow body comprises at least one segment;

said at least one segment being disposed within said flow channel; and said at least one segment being disposed to divide said flow channel into a plurality of channel portions.

8. The device according to claim 7 wherein:

said second flow body comprises a steel tube; and said steel tube comprises slots disposed therein.

9. The device according to claim 8 wherein:

said flow channel has a longitudinal axis;

said longitudinal axis is defined substantially transverse to said axis of rotation of said second flow body;

said second flow body comprises a first wall portion and a second wall portion;

said flow channel is disposed between and is defined by said first and second wall portions;

each of said first and second wall portions has a width, said width being defined transverse to said longitudinal axis of said flow channel; and said width of said first wall portion is substantially equal to said width of said second wall portion at any point along said longitudinal axis of said flow channel.

10. The device according to claim 9 wherein:

said second flow body comprises a plurality of supports;

said plurality of supports are disposed substantially transverse to said longitudinal axis of said second support body; and said plurality of supports is disposed to stabilize said first and second wall portions.

11. The device according to claim 10 wherein said rotating means comprises means for rotating said second flow body proportionally with respect to the rotation of said first flow body.

12. The device according to claim 11 wherein said proportional rotating means comprises means for rotating said second flow body about 1.5 degrees per degree of rotation of said first flow body.

13. The device according to claim 12 wherein:

said flow channel has a width defined between said first and second wall portions;

said flow channel has upstream and downstream ends;

said flow channel has a first width at said upstream end;

said flow channel has a second width at said downstream end; and said second width is greater than said first width.

14. The device according to claim 13 wherein:

said second flow body has a cross section;

said cross section is defined substantially transverse to said axis of rotation; and said cross-section is substantially circular in shape.

15. The device according to claim 7 wherein:

said flow channel comprises a first flap and a second flap;

said first flap is disposed adjacent said first wall portion; and said second flap is disposed adjacent said second wall portion.

16. The device according to claim 10 wherein said means for rotating said second flow body in the same direction of rotation as said first flow body comprises means for rotating said second body non-proportionally to the rotation of said first body.

17. A ship, said ship comprising a hull and a stabilizing device for feeding hydrodynamic forces into the hull, said stabilizing device comprising:

a first stabilizing body;

said first stabilizing body comprising an arrangement to connect said first stabilizing body to the ship;

said first stabilizing body having an upstream edge and a downstream edge;

a second stabilizing body;

said second stabilizing body being disposed downstream of said downstream edge of said first stabilizing body;

said second stabilizing body comprises a flow channel; and said flow channel being disposed to allow water passing across said first stabilizing body to flow through said flow channel of said second stabilizing body.

18. The ship according to claim 17 wherein said flow channel comprises a recess disposed within said second stabilizing body.

19. The ship according to claim 18 wherein:

said first stabilizing body has a longitudinal axis extending from said upstream edge to said downstream edge;

said second stabilizing body has an axis of rotation;

said axis of rotation of said second stabilizing body is substantially transverse to said longitudinal axis of said first stabilizing body;

said second stabilizing body is rotatable about said axis of rotation to adjust a flow path of water passing said first stabilizing body;

said first stabilizing body has a first thickness defined substantially transverse to said longitudinal axis, said first thickness being substantially adjacent said upstream edge;

said first stabilizing body has a second thickness defined substantially transverse to said longitudinal axis, said first thickness being substantially adjacent said downstream edge;

said first thickness is substantially greater than said second thickness;

said first stabilizing body has an axis of rotation; and said first stabilizing body comprises means for rotating said second stabilizing body about said axis of rotation of said second stabilizing body upon rotation of said first stabilizing body about said axis of rotation of said first stabilizing body.

20. The ship according to claim 19 wherein said means for rotating said second stabilizing body about said axis of rotation of said second stabilizing body upon rotation of said first stabilizing body about said axis of rotation of said first stabilizing body comprises means for rotating said second stabilizing body about 1.5 degrees per degree of rotation of said first stabilizing body.

* * * * *